US006892634B2

(12) United States Patent
Mezger et al.

(10) Patent No.: US 6,892,634 B2
(45) Date of Patent: May 17, 2005

(54) PROTECTING DEVICE FOR A PRINTING MACHINE CYLINDER

(75) Inventors: Franz Konrad Mezger, Lauda-Königshofen (DE); Horst-Walter Hauer, Würzburg (DE); Kurt Johannes Weschenfelder, Zell/Main (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/475,846

(22) PCT Filed: Mar. 26, 2002

(86) PCT No.: PCT/DE02/01089

§ 371 (c)(1),
(2), (4) Date: Oct. 31, 2003

(87) PCT Pub. No.: WO02/092346

PCT Pub. Date: Nov. 21, 2002

(65) Prior Publication Data

US 2004/0112234 A1 Jun. 17, 2004

(30) Foreign Application Priority Data

May 12, 2001 (DE) ..... 101 23 324

(51) Int. Cl.[7] ..... B41F 13/42; B41F 33/00

(52) U.S. Cl. ..... 101/216; 101/480

(58) Field of Search ..... 101/216, 217, 101/218, 247, 479, 480, 139, 140, 144, 145, 182, 184, 185

(56) References Cited

U.S. PATENT DOCUMENTS

| | | | | | |
|---|---|---|---|---|---|
| 5,241,903 | A | * | 9/1993 | Lampic | 100/349 |
| 5,875,714 | A | * | 3/1999 | Winkler et al. | 101/216 |
| 6,786,156 | B2 | * | 9/2004 | Takebayashi et al. | 101/480 |
| 2003/0200883 | A1 | * | 10/2003 | Bitterich et al. | 101/216 |

FOREIGN PATENT DOCUMENTS

| | | |
|---|---|---|
| DE | 196 03 666 A1 | 8/1997 |
| DE | 196 03 666 C2 | 6/1998 |

* cited by examiner

*Primary Examiner*—Leslie J. Evanisko
(74) *Attorney, Agent, or Firm*—Jones Tullar & Cooper PC

(57) ABSTRACT

A protective device for a printing machine cylinder assures a risk-free flying changeover of printing plates. The protective device includes a rotatable ring that supports a sleeve-shaped cover. The sleeve-shaped cover can be positioned to partially envelop or cover the cylinder at a separation of the cylinder from another cylinder or a roller in the printing machine.

7 Claims, 3 Drawing Sheets

PROTECTING DEVICE FOR A PRINTING MACHINE CYLINDER

FIELD OF THE INVENTION

The present invention is directed to a protective device for a cylinder of a printing press. The protection device is used for the selective covering of rotating cylinder elements.

BACKGROUND OF THE INVENTION

A protective device on forme cylinders is known from DE 196 03 666 C2. That protective device is embodied to be pivotable by rotating eccentric bearing bushings.

SUMMARY OF THE INVENTION

The object of the present invention is directed to providing a protective device for a cylinder of a printing press.

In accordance with the present invention, this object is attained by providing a protective device for a cylinder of a printing press that is usable for the selective covering of rotating cylinder elements. The protective device may have a rotatable ring on which a sheath-shaped cover, for the partial covering of a cylinder, is arranged. The cover can be selectively placed into a gap between two cylinders or a gap between a cylinder and a roller. The cover may be provided with its own actuating device.

The advantages to be gained by the present invention lie, in particular, in the protection from inadvertent touching of rotating cylinder elements, in the course of printing plate changes, which the protective device provides. The protective device is not connected with eccentric bushings, so that no additional drive mechanism for compensating for different pivot movements is required.

BRIEF DESCRIPTION OF THE DRAWINGS

A preferred embodiment of the present invention is represented in the drawings and will be described in greater detail in what follows.

Shown are in.

DESCRIPTION OF THE PREFERRED EMBODIMENT

Figure 1:
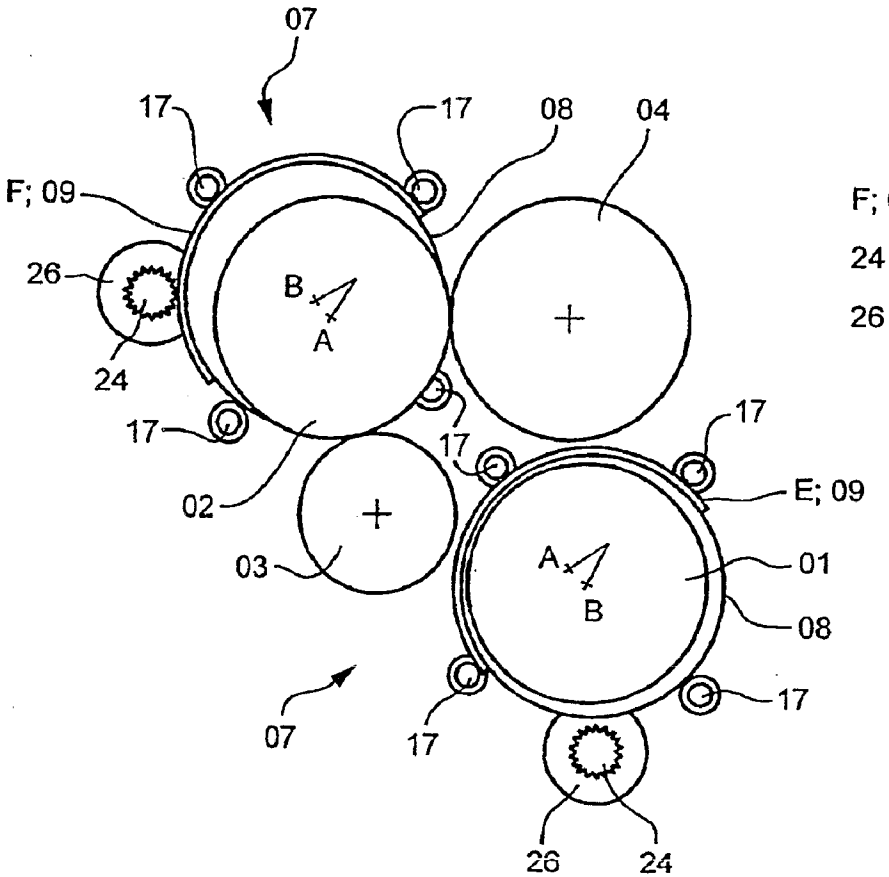
FIG. 1, a schematic end view of a printing group having two plate cylinders which can be brought into and out of contact, wherein the first plate cylinder is in a print-off position, and the associated cover is opened, in FIG. 2, a schematic end view analogous to FIG. 1, with the first plate cylinder in a print-on position and with the cover closed, in FIG. 3, a schematic end view analogous to FIG. 1, with the second plate cylinder in a print-off position, and with the associated cover opened, in FIG. 4, a cross-section taken along line IV—IV of FIG. 3 through the first plate cylinder, wherein an upper spacing holder 22, as well as the associated holding roller 17 have been omitted, and in FIG. 5, a cross section taken along line V—V in accordance with FIG. 2 in an enlarged partial representation.
Figure 4:
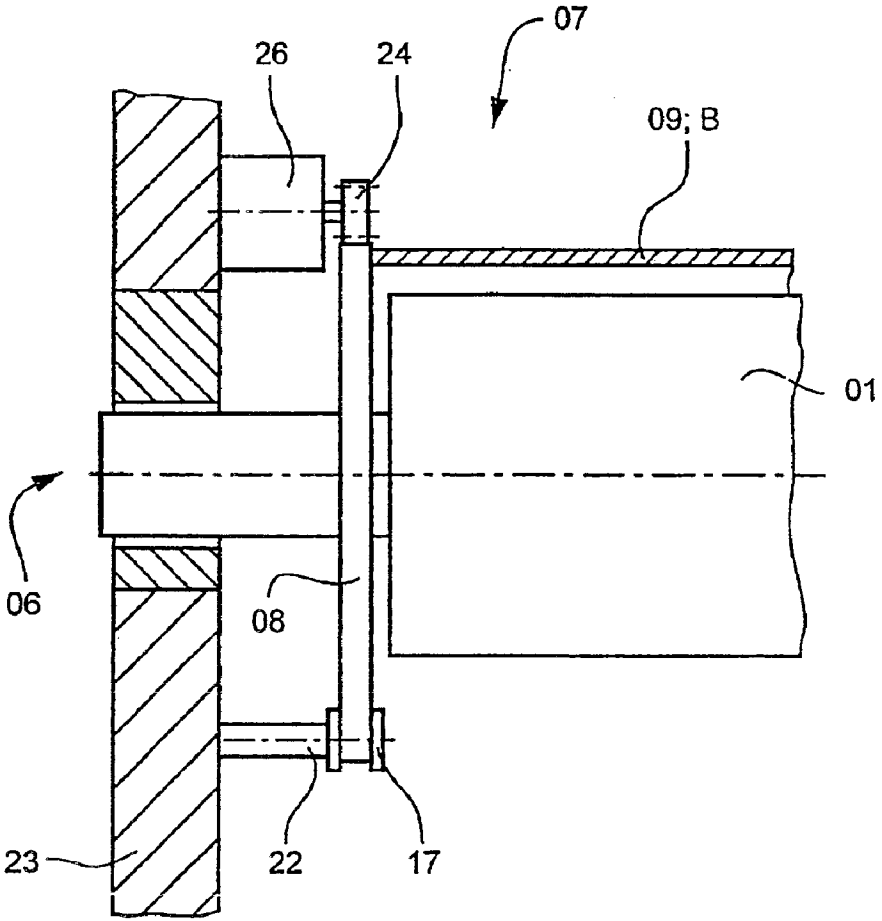

Referring initially to FIG. 1, there may be seen a printing group which includes the protective device, generally at 07, in accordance with the present invention. The printing group, which may be used, for example for flexographic printing, consists of two cylinders 01, 02, each of which can be equipped with printing plates, and which thus are, for example, printing or forme cylinders 01, 02, which can be placed either together or individually against a cylinder 03, for example a counter-pressure cylinder 03, as well as a roller 04, for example a screen roller 04. The typically individual placement of each of the forme cylinders 01, 02 is performed, in each case, by the use of cylinder positioning devices, such as eccentric bearing bushings 06, as shown in FIG. 4. In this way, either a print-on position A, or a print-off position B of the forme cylinders 01, 02 results.

The screen roller 04 is connected with an ink application arrangement, which is not specifically represented. All of the respective cylinders 01, 02, 03 and the roller 04 can be separately driven, for example by the use of suitable drive motors which are not specifically shown in the several drawings.

Figure 5:
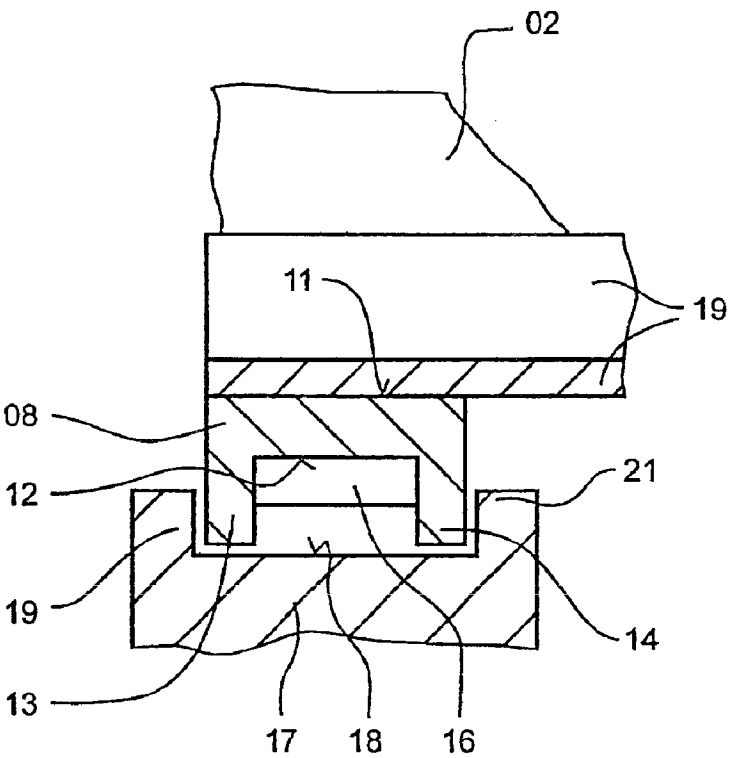

A protective device 07 for either or both the forme cylinders 01 or 02 consists of a rotatable ring 08, which is shown most clearly in FIGS. 4 and 5, and on which a sheath-shaped or trough-shaped cover 09 is fastened. The cover 09 encloses approximately half of the circumference of the forme cylinder 01 or 02, as may be seen in FIGS. 1, 2 and 3.

On its interior circumference 11, the ring 08 has the sheath-shaped cover 09. On its outer circumference 12, the ring 08 has two annular tori 13, 14, as seen in FIG. 5, which annular tori 13, 14 are spaced apart from each other and between which, viewed in the circumferential direction of the ring 08, a toothed device 16, or the like, is arranged.

The ring 08 is supported by several, for example by four holding rollers 17, which are arranged evenly distributed over the circumference of the ring 08. The outer edges of the tori 13, 14 act on a roller running surface 18, which is embodied in the manner of a groove bottom, and which running surface 18 is situated on the circumference of the holding rollers 17, as seen in FIG. 5. Lateral walls 19, 21 secure the ring 08 supported by the rollers 17 against axial displacement. The holding rollers 17 are supported on the free ends of respective spacing holders 22 in a lateral frame 23, for example, as is shown most clearly in FIG. 4.

Figure 3:
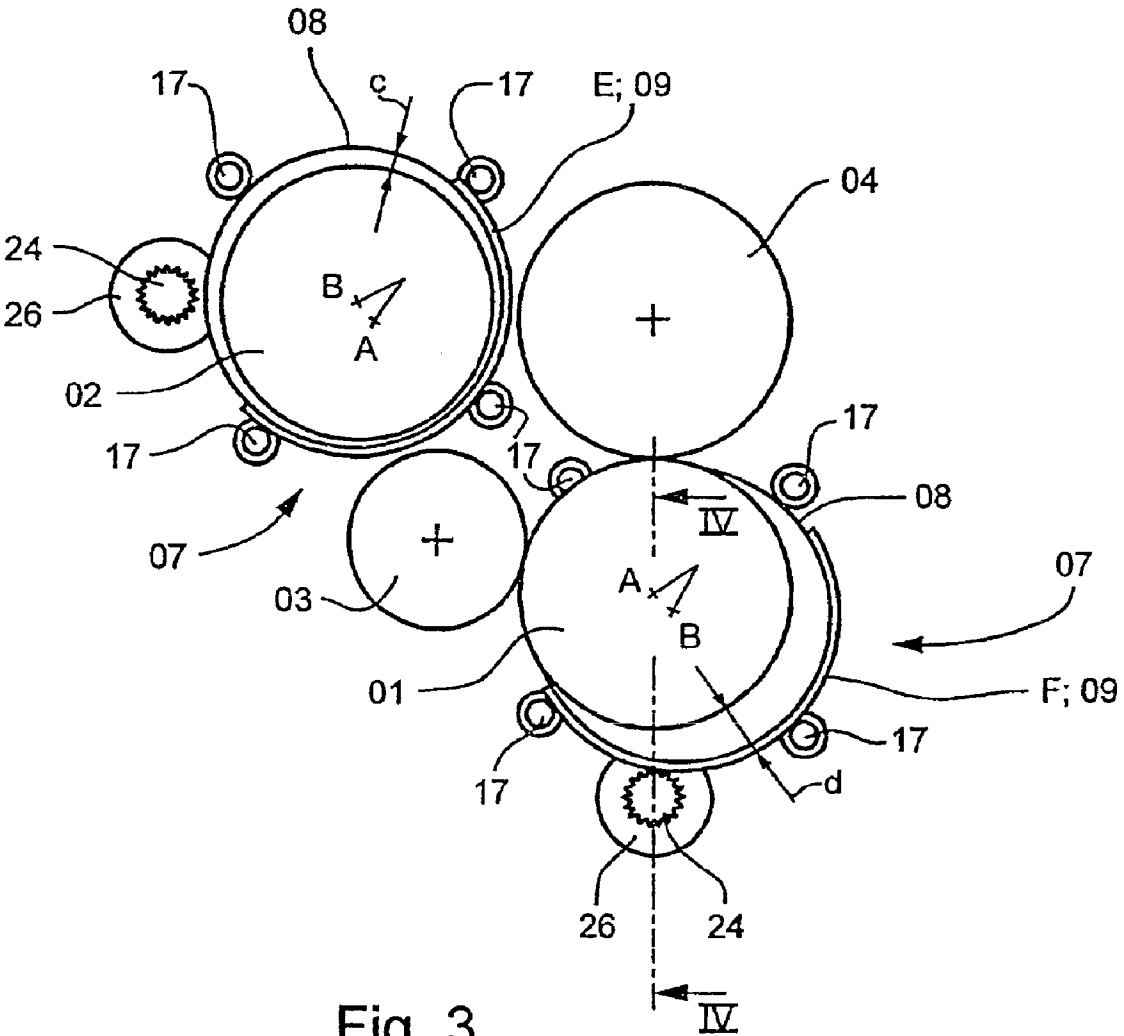

In an out-of-contact position, i.e. in the print-off position B, the periphery of the forme cylinder 01 or 02 is remote from the cover 09 by a minimum distance c, and in a contact position, i.e. in the print-on position A, by a maximum distance d. These two positions and distances are depicted in FIG. 3.

The ring 08 can be rotated manually or by the use of a pinion 24, which engages the toothed device 16 and which pinion 24 can be driven or rotated, by the use of a drive motor 26 which is fixed in place in the lateral frame. The placement of the drive motor 26 and the pinion 24 is shown most clearly in FIG. 4.

Each cover 09 of the protective device 07 can be rotated between two positions: cover 09 "open" in the position E, or cover 09 "closed" in the position F, each viewed from the operating side of the printing group. A closed position F of an upper cover 09, and an open position E of a lower cover 09 are shown in FIG. 1.

For exactly fixing the two positions E, F of the cover 09, limit stop switches, which are not specifically depicted, and which can be fixed in place in the lateral frame, for example, as well as cams which are fixed on the ring, can work together. It is also possible to provide markers fixed on the ring 08 and sensors fixed in place of the lateral frame.

The function of the protective device 07 for a printing machine cylinder, in accordance with the present invention, is as follows:

Referring initially to the representation in FIG. 1, the cylinders 02, 03 and the roller 04 rotate in contact with each other, while the first forme cylinder 01 is in the print-off position and the cover 09 associated with the first forme cylinder is in the "open" position E. A plate change can now be performed on cylinder 01 whose cover 09 is in its "open" position.

Figure 2:
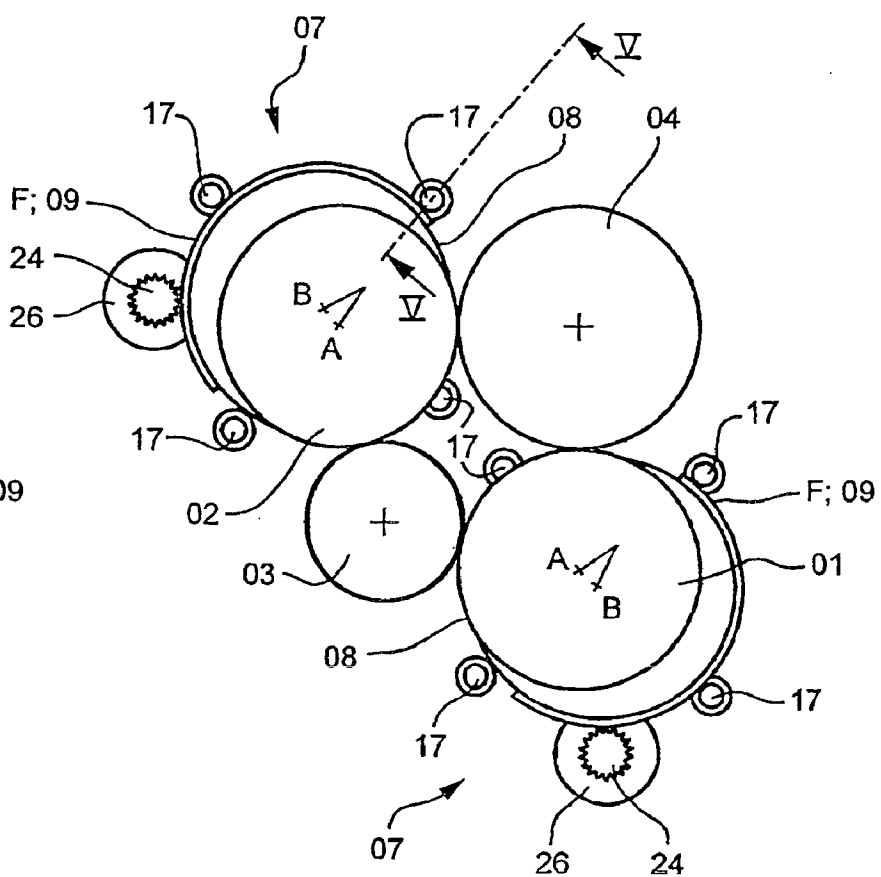

In the representation in FIG. 2, all of the cylinders 01, 02, 03 and the roller 04 rotate in contact with each other. In this case, all of the covers 08 have been rotated into the "closed" position F.

In the representation shown in FIG. 3, the second forme cylinder 02 is in the print-off position, wherein the cover 09 is in the "open" position E. A plate change can be performed or other work can be done on cylinder 02.

Because of the provision of a suitable locking device, which is not specifically shown, the cover 09 can only be rotated into the position "open" E in the print-off position B of its associated cylinder or roller.

It is also possible to use different drive mechanisms for the protective device 07. For example, toothed belts or the like can be used instead of pinion 24 and motor 26.

It is also conceivable for the cover 09 to have its own actuating drive, which can be operated independently of an actuating drive for bringing a cylinder 01, 02 into or out of contact. The cover 09 can be selectively placed into a gap between two cylinders 01, 03; 02, 03, or into a gap between a cylinder and a roller 01, 04; 02, 04.

In accordance with a second preferred embodiment, which is not specifically represented, in a 10-cylinder satellite printing group two rubber blanket cylinders can each operate against a counter-pressure cylinder in accordance with the imprinter principle. A separate forme cylinder, which can be pivoted in and out, is assigned to each one of the two rubber blanket cylinders.

If it is now intended to take one of the two forme cylinders 01, 02 out of production, for example for a flying plate change, the respective forme cylinder 01, 02 is pivoted away from the associated rubber blanket cylinder and the counter-pressure cylinder, for example by use of eccentric bushings. In this case, each rubber blanket cylinder has its own associated protection device 07, as described above. The associated protective device 07 can be rotated in such a way that, with the forme cylinder 01, 02 stopped and the rubber blanket cylinders rotating, each rubber blanket cylinder is covered in the handling area.

Suitably, each cover 09 is supported on both of its ends, typically from the direction of both of the lateral frames. One ring 08, and the associated holding rollers 17, are seated fixed in each of the two spaced lateral frames. Only one lateral frame 23 is shown in FIG. 4. The other of the two lateral frames is essentially the same.

While preferred embodiments of a protective device for a printing machine cylinder, in accordance with the present invention, have been set forth fully and completely hereinabove, it will be apparent to one of skill in the art that various changes, in, for example, the overall size of the cylinders, the drives for the cylinders and the like could be made without departing from the true spirit and scope of the present invention which is accordingly to be limited only by the following claims.

What is claimed is:

1. A protective device for cylinders of a printing press comprising:

a rotatable ring;

a sheath-shaped cover on said rotatable ring, said sheath-shaped cover being spaced at a distance from, and adapted to partially cover a surface of at least one of the cylinders.

2. The protective device of claim 1 wherein said cover is a trough.

3. The protective device of claim 1 further including a drive motor and wherein said ring is rotatable by said drive motor.

4. The protective device of claim 1 wherein said cover is fastened on said ring.

5. A protective device in combination with a printing press having cylinders comprising:

a rotatable ring;

a sheath-shaped cover on said rotatable ring, said sheath-shaped cover being spaced at a distance from, and adapted to partially cover a surface of at least one of the cylinders; and a lateral frame of the printing press, said ring being supported by said lateral frame.

6. A protective device in combination with a printing press having cylinders comprising:

a rotatable ring;

a sheath-shaped cover on said rotatable ring, said sheath-shaped cover being spaced at a distance from, and adapted to partially cover a surface of at least one of the cylinders; and a lateral frame of the printing press; and holding rollers secured to said lateral frame of the printing press, said holding rollers supporting said ring.

7. A protective device for a cylinder of a printing press comprising:

a cover, said cover being selectively positionable in a gap defined by cylinders of the printing press;

an actuating device for said cover; and a cylinder positioning device usable to bring the cylinders in and out of contact, said cover actuating device being operable independently of said cylinder positioning device.

* * * * *